US006443771B2

(12) United States Patent
Kondo et al.

(10) Patent No.: US 6,443,771 B2
(45) Date of Patent: Sep. 3, 2002

(54) FUSE BOX, FUSE, AND FUSE BLOCK

(75) Inventors: Hiroki Kondo; Goro Nakamura; Takahiro Sato, all of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/818,645

(22) Filed: Mar. 28, 2001

(30) Foreign Application Priority Data

Mar. 31, 2000 (JP) ..... 2000-099745

(51) Int. Cl.[7] ..... H01R 13/68
(52) U.S. Cl. ..... 439/621; 439/680; 439/831
(58) Field of Search ..... 439/680, 681, 439/620–621, 698, 830, 831

(56) References Cited

U.S. PATENT DOCUMENTS 4,604,602 A 8/1986 Borzoni
4,768,978 A * 9/1988 Wettengel et al. ..... 439/621
5,023,752 A * 6/1991 Detter et al. ..... 361/399
5,040,097 A * 8/1991 Stribel ..... 361/395
5,285,011 A * 2/1994 Shimochi ..... 174/52.1
5,588,876 A * 12/1996 Hayes et al. ..... 439/622

FOREIGN PATENT DOCUMENTS

JP 1-45174 10/1989

* cited by examiner

*Primary Examiner*—Khiem Nguyen
(74) *Attorney, Agent, or Firm*—Armstrong, Westermann and Hattori, LLP

(57) ABSTRACT

A fuse block 1 includes a fuse box 2 and a high voltage fuse 3. The fuse box 2 has a high voltage mounting part 6. The high voltage mounting part 6 is provided with an opening 6*a,* a plurality of surrounding walls 7*a,* 7*b,* and projections 8. Each of the projections 8 is projected from both the surrounding walls 7*a,* 7*b* which are adjacent to each other into an interior of the high voltage mounting part 6. A rated voltage fuse cannot be mounted to the high voltage mounting part 6 because of the presence of the projections 8. The high voltage fuse 3 includes a housing 10 having outer walls 14*a,* 14*b* and recesses 13. Each of the recesses 13 is formed by displacing both the outer walls 14*a,* 14*b* which are adjacent to each other. When the high voltage fuse 3 is mounted to the high voltage mounting part 6, the recesses 13 and the projections 8 will not interfere with each other.

8 Claims, 6 Drawing Sheets

FUSE BOX, FUSE, AND FUSE BLOCK

BACKGROUND OF THE INVENTION

1. Field of the Invention

The present invention relates to a fuse box, a fuse, and a fuse block to be installed in a vehicle which is a moving body.

2. Description of the Related Art

In the vehicle as the moving body, there are various transmission lines for transmitting electric power, signals and so on, such as busbars contained in a connection box, such as a junction block, a relay box, a fuse block, terminals of electrical connector, etc.

Heretofore, a voltage of the electric power for use in the transmission lines has been mainly 12V in the case of a general passenger automobile, and has been 12V×2=24V in the case of a large vehicle, such as a bus, a truck, etc. However, in view of recent requests for an increase in driving efficiency of loads and for driving at most appropriate efficiency per the load, it is now being considered to employ a power system capable of supplying electric power having higher voltage than before, such as 36V, for example.

In the above described transmission lines, there have been used fuse blocks in which a number of detachable fuses are disposed for protecting electric circuits of various types of electric equipment from breakdown. Since the fuse block may sometimes include relays and busbars, the fuse block is also called a relay box or a junction block, or generally called a connection box. In this specification, the fuse block, relay box, junction box and connection box will be hereinafter called the fuse block, in general.

In the vehicle in which employment of the power system capable of supplying electric power having higher voltage than before, as described above, is intended, it is considered to employ a fuse block provided with a first fuse (hereinafter referred to as high voltage fuse) and a fuse box having a first mounting part to which the high voltage fuse can be detachably mounted. The fuse block is supplied with the electric power having a first voltage, such as 36V, higher than 32V which has been conventionally employed. The high voltage fuse is adapted to be fused when the electric power above an amperage corresponding to the first voltage has been supplied and interrupts the supply of the power to the various loads.

Meanwhile, in the vehicle installed with the conventional power system, which supplies electric power of 12V and 24V, a fuse block provided with a second fuse (hereinafter referred to as a rated voltage fuse) and a fuse box having a second mounting part to which the rated voltage fuse can be detachably mounted is employed. The above described rated voltage fuse is supplied with electric power having a second voltage, such as 12V and 24V, which is lower than the aforesaid first voltage. The rated voltage fuse is adapted to be fused when the electric power above an amperage corresponding to the second voltage has been supplied and interrupts the supply of the power to the various loads.

The fuse block, fuse box and fuse, which have been heretofore employed, are constructed in such a manner that the rated voltage fuse can be also mounted to the first mounting part.

For this reason, when assembling the fuse block to be installed in the vehicle in which employment of the power system capable of supplying the power having higher voltage than before is intended, there has been such a fear that the rated voltage fuse may be mounted to the first mounting part by mistake.

If the rated voltage fuse has been mounted to the first mounting part, such an inconvenience may occur that the rated voltage fuse may be fused and the loads may not be supplied with the power, even though the voltage of the power which is supplied to the loads connected to the first mounting part is normal. In some cases, a fusible body of the rated voltage fuse may be blown off due to the high amperage, and terminals of the rated voltage fuse may be short circuited to each other.

When the terminals of the rated voltage fuse have been short circuited to each other, it is feared that the rated voltage fuse and the fuse block may be melted down and broken. In the worst case, the loads connected to the first mounting part may be damaged.

As described above, in the conventional structure of the fuse block, fuse box and fuse, in a case where the rated voltage fuse for conventional use has been mounted to the mounting part to be supplied with the power having the first voltage over 32V, it has been feared that the loads may not be supplied with the power even though the voltage of the power supplied to the loads is normal, or that the fuse block and the fuse itself may be melted and broken.

In view of the above, an object of the invention is to provide a fuse box, a fuse, and a fuse block which can prevent a fuse adapted to be fused at an amperage corresponding to a voltage which has been conventionally used from being mounted to the mounting part which is supplied with electric power having higher voltage than before.

SUMMARY OF THE INVENTION

In order to solve the above described problems and attain the object, according to a first aspect of the present invention, there is provided a fuse box comprising a box body formed in a box-like shape, and at least one first mounting part adapted to contain a pair of first receiving terminals which are arranged in parallel to each other, one of the first receiving terminals being supplied with electric power having a first voltage higher than 32V, wherein the first mounting part includes blocking means for preventing a rated voltage fuse which is so adapted as to fuse at an amperage corresponding to a second voltage which is lower than the first voltage from being mounted thereto.

In the fuse box according to the first aspect, the blocking means block the rated voltage fuse from being mounted to the first mounting part which contains the first receiving terminals and is supplied with the electric power having the first voltage higher than 32V. Accordingly, the rated voltage fuse can be prevented from being mounted to the first mounting part.

In the fuse box according to a second aspect of the present invention, the first mounting part is formed by denting a surface of the box body, including an opening which opens in the surface of the box body and a plurality of surrounding walls continued from peripheral edges of the opening, and the blocking means include projections which are projected from the surrounding walls into the first mounting part.

In the fuse box according to the second aspect, because the blocking means are the projections projected from the surrounding walls which constitute the first mounting part, the projections are abutted against the rated voltage fuse when the rated voltage fuse is mounted to the first mounting part. Thus, the rated voltage fuse can be more reliably prevented from being mounted to the first mounting part.

In the fuse box according to a third aspect of the invention, the surrounding walls of the first mounting part include a pair of first surrounding walls which are opposed to each other in a direction in which the first receiving terminals are juxtaposed, and a pair of second surrounding walls which are continued from the first surrounding walls and opposed to each other in a direction intersecting the direction in which the first receiving terminals are juxtaposed, and the projections are formed by projecting from both the first surrounding walls and the second surrounding walls which are adjacent to each other across the first surrounding walls and second surrounding walls.

In the fuse box according to the third aspect, because the projections are projected across the first surrounding walls and the second surrounding walls which constitute the first mounting part, the projections are reliably abutted against the rated voltage fuse when the rated voltage fuse is mounted to the first mounting part. Thus, the rated voltage fuse can be more reliably prevented from being mounted to the first mounting part.

There is further provided, according to a fourth aspect of the present invention, a fuse comprising a pair of connecting terminals arranged in parallel to each other, one of the connecting terminals being capable of supplying electric power having a first voltage higher than 32V, and a housing adapted to receive one end portion of the connecting terminals, wherein the housing includes outer walls forming an outer shell, and recesses formed by denting surfaces of the outer walls.

In the fuse according to the fourth aspect, the housing is provided with the recesses formed by denting the surfaces of the outer walls. Therefore, by providing the mounting part of the fuse with projections, or the like, which will not interfere with the recesses, the rated voltage fuse, which has been conventionally used, can be prevented from being mounted to the mounting part.

In the fuse according to a fifth aspect of the invention, the outer walls of the housing include a pair of first outer walls which are opposed to each other in a direction in which the first connecting terminals are juxtaposed, and a pair of second outer walls which are continued from the first outer walls and opposed to each other in a direction intersecting the direction in which the first connecting terminals are juxtaposed, and the recesses are formed by denting the first outer walls and the second outer walls which are adjacent to each other across the first outer walls and second outer walls.

In the fuse according to the fifth aspect, the housing has the first outer walls and the second outer walls, and the recesses are formed across the first outer walls and the second outer walls. Therefore, by providing the mounting part for the fuse with projections, or the like, which will not interfere with the recesses, the rated voltage fuse, which has been conventionally used, can be prevented from being mounted to the mounting part.

There is further provided, according to a sixth aspect of the present invention, a fuse block comprising a box body formed in a box-like shape and a first mounting part adapted to receive a pair of first receiving terminals which are arranged in parallel to each other, one of the first receiving terminals being supplied with electric power having a first voltage higher than 32V, a second mounting part adapted to receive a pair of second receiving terminals which are arranged in parallel to each other, one of the second receiving terminals being supplied with electric power having a second voltage lower than the first voltage, a first fuse having a pair of first connecting terminals which are arranged in parallel to each other and adapted to be respectively connected to the first receiving terminals, and a first fusible body which is adapted to fuse when the electric power whose amperage is higher than a value corresponding to the first voltage has been supplied, the first fuse being adapted to be detachably mounted to the first mounting part, and a second fuse having a pair of second connecting terminals which are arranged in parallel to each other and adapted to be respectively connected to the second receiving terminals, and a second fusible body which is adapted to fuse when electric power whose amperage is higher than a value corresponding to the second voltage has been supplied, the second fuse being adapted to be detachably mounted to the second mounting part, wherein the first mounting part is formed by denting a surface of the box body, including an opening which opens in the surface of the box body, a plurality of surrounding walls continued from peripheral edges of the opening, and projections which are projected from the surrounding walls into the first mounting part, and the first fuse includes the pair of the first connecting terminals, a housing adapted to receive one end portions of the first connecting terminals and including outer walls forming an outer shell, and recesses which are formed by denting surfaces of the outer walls and may not interfere with the projections.

In the fuse block according to the sixth aspect, the first mounting part is provided with the projections projected from the surrounding walls. Accordingly, the second fuse cannot be mounted to the first mounting part. Meanwhile, the first fuse is provided with the recesses which are dented from the outer walls and may not interfere with the projections. Accordingly, the first fuse can be reliably mounted to the first mounting part.

In the fuse block according to a seventh aspect of the invention, the surrounding walls of the first mounting part include a pair of first surrounding walls which are opposed to each other in a direction in which the first receiving terminals are juxtaposed, and a pair of second surrounding walls which are continued from the first surrounding walls and opposed to each other in a direction intersecting the direction in which the first receiving terminals are juxtaposed, the outer walls of the housing include a pair of first outer walls which are opposed to each other in a direction in which the first connecting terminals are juxtaposed, and a pair of second outer walls which are continued from the first outer walls and opposed to each other in a direction intersecting the direction in which the first connecting terminals are juxtaposed, the projections are formed by projecting from the first surrounding walls and the second surrounding walls which are adjacent to each other across the first surrounding walls and second surrounding walls, and the recesses are formed by recessing the first outer walls and the second outer walls which are adjacent to each other across the first outer walls and the second outer walls.

In the fuse block according to the seventh aspect, the projections are formed across the first surrounding walls and the second surrounding walls adjacent to each other. Therefore, the second fuse can be prevented from being mounted to the first mounting part, and the first fuse can be reliably mounted to the first mounting part.

In the fuse block according to an eighth aspect of the invention, the projections and the recesses come into alignment with each other when the first fuse has been mounted to the first mounting part.

In the fuse box according to the eighth aspect, because the projections and the recesses come into alignment with each other, the first fuse can be more reliably mounted to the first mounting part.

DESCRIPTION OF THE PREFERRED EMBODIMENTS

Figure 1:
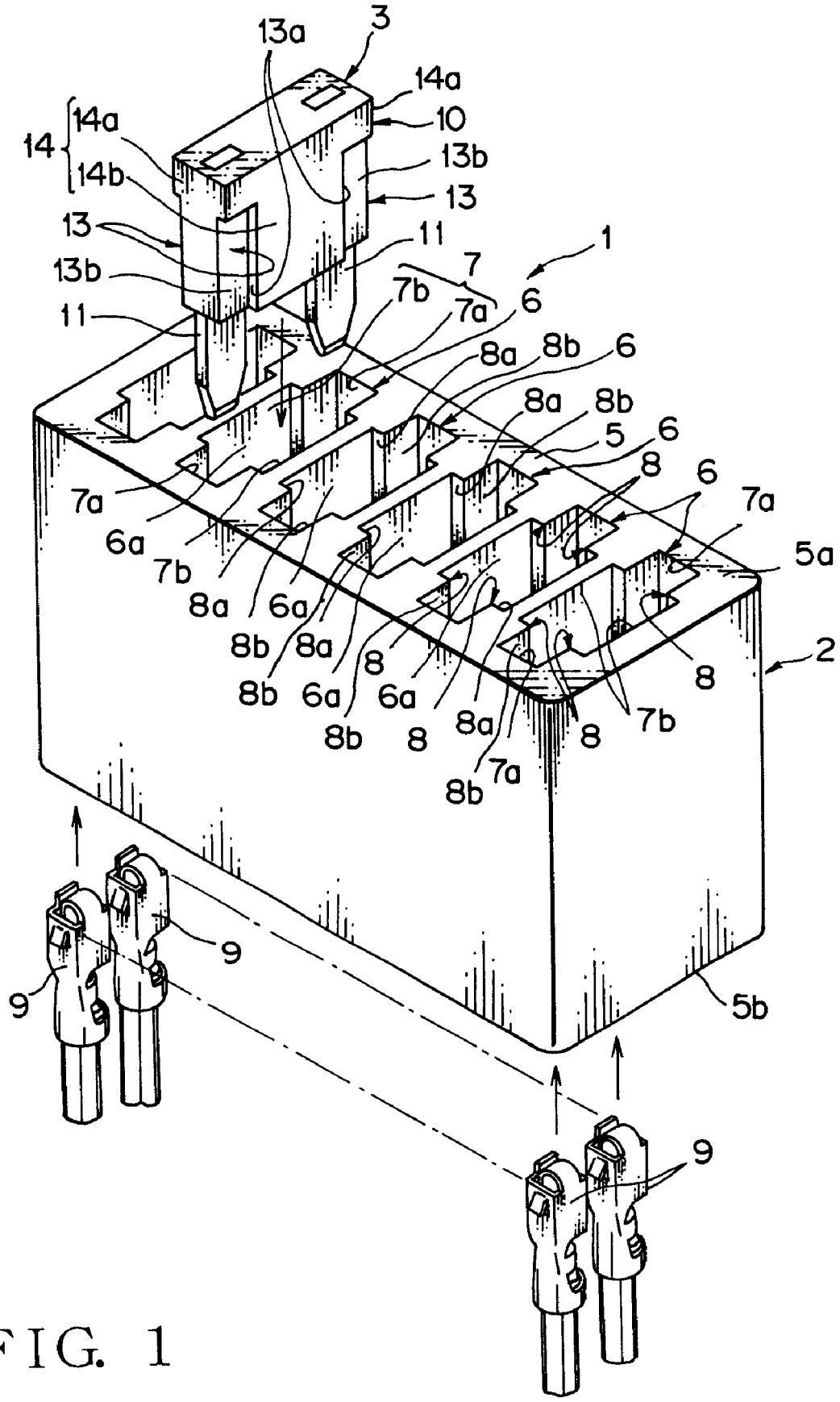
FIG. 1 is a perspective view showing a structure of a fuse block according to a first embodiment of the present invention.

Now, the first embodiment according to the present invention will be described referring to FIGS. 1 to 3, and FIGS. 6 to 9. A fuse block 1 according to the first embodiment has a fuse box 2 and a high voltage fuse 3 as shown in FIG. 1 and so on.

The fuse box 2 includes a box body 5, and a plurality of high voltage mounting parts 6 as a first mounting part. Each of the high voltage mounting parts 6 has a terminal insertion bore 6*b* which extends from an opening 6*a* formed in one surface 5*a* of the box body 5 to the other surface 5*b* positioned at an opposite side of the surface 5*a* (See FIGS. 8 and 9).

A pair of high voltage receiving terminals 9(See FIG. 1) are inserted into the high voltage mounting part 6 through the terminal insertion bore 6*b*. These pair of the high voltage receiving terminals 9 correspond to first receiving terminals described in the claims.

One of the high voltage receiving terminals 9 is electrically connected to a high voltage power source which supplies power having a first voltage, for example, of36V. The other of the high voltage receiving terminals 9 is electrically connected to a large capacity load, such as an igniter, a wiper motor, a heat wire defogger of a rear window, a window motor of a door trim, etc. having a rated voltage capacity of the aforesaid first voltage. In this manner, one of the high voltage receiving terminals 9 is supplied with the power having the first voltage over 32V.

The high voltage mounting part 6 has an opening 6*a* formed in one surface 5*a* of the box body 5, a plurality of surrounding walls 7 continued from peripheral edges of the opening 6*a,* and projections 8 as blocking means. the opening 6*a* is formed in a substantially rectangular shape in a plan view.

The surrounding walls 7 include first surrounding walls 7*a* which are opposed to each other in a direction in which the high voltage receiving terminals 9 are juxtaposed, and second surrounding walls 7*b* which are opposed to each other in a direction perpendicular to the direction in which the high voltage receiving terminals 9 are juxtaposed. Surfaces of both the first and the second surrounding walls 7*a,* 7*b* are substantially flat.

The projections 8 are provided at corners between the first surrounding walls 7*a* and the second surrounding walls 7*b,* respectively. In the illustrated embodiment, the projections 8 are provided at the four corners of the opening 6*a*. Each of the projections 8 has a first wall 8*a* projected from the second surrounding wall 7*b* and a second wall 8*b* projected from the first surrounding wall 7*a*.

The first wall 8*a* projects into an interior of the high voltage mounting part 6 and formed flat in parallel to the first surrounding wall 7*a*. The second wall 8*b* projects into an interior of the high voltage mounting part 6 and formed flat in parallel to the second surrounding wall 7*b*.

Figure 2:
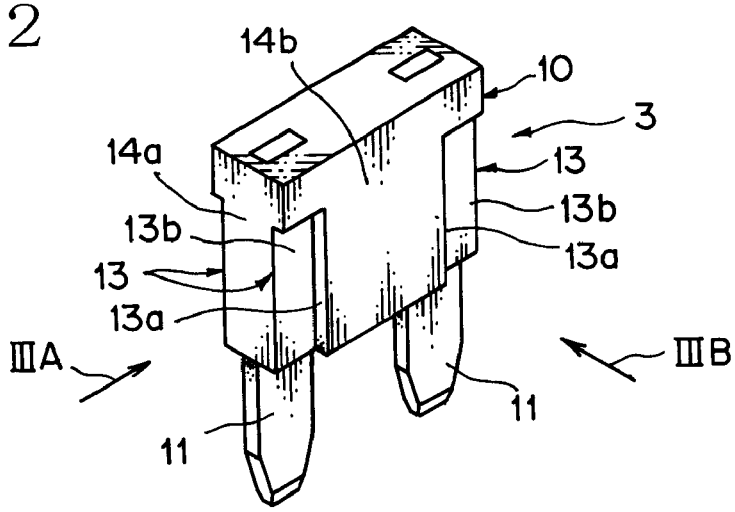
FIG. 2 is a perspective view showing a high voltage fuse in the embodiment of FIG. 1.
Figure 3A:
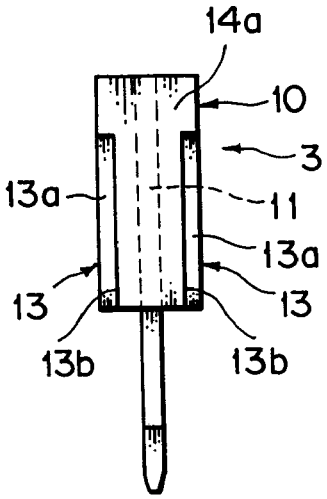
FIG. 3A is a view of the high voltage fuse as seen from a direction of an arrow IIIA of FIG. 2.
Figure 3B:
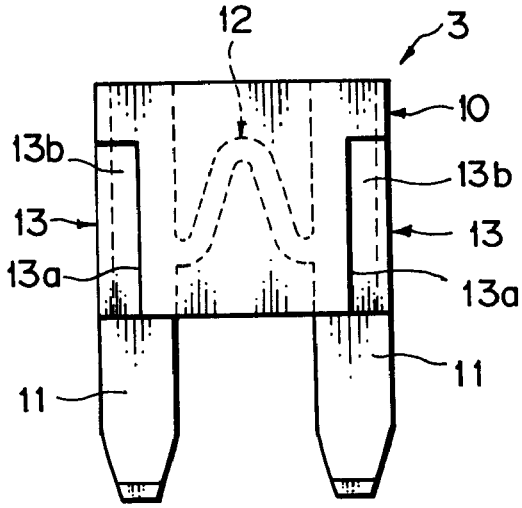
FIG. 3B is a view of the high voltage fuse as seen from a direction of an arrow IIIB of FIG. 2.

The high voltage fuse assembly 3 is detachably mounted in the high voltage mounting part 6 through the opening 6*a*. As shown in FIGS. 1 to 3, the high voltage fuse 3 includes a pair of first connecting terminals 11, a housing 10, a first fusible body 12, and recesses 13.

The first connecting terminals 11 are respectively formed of electrically conductive metal in a substantially blade-like shape. The pair of the first connecting terminals 11 are arranged in parallel to each other. When the high voltage fuse 3 has been mounted to the high voltage mounting part 6, the first connecting terminals 11 are respectively connected to the pair of the high voltage receiving terminals 9. One of the first connecting terminals 11 is supplied with the electric power having the aforesaid first voltage.

The housing 10 is made of insulating synthetic resin or the like, and formed in a box-like shape for containing respective one end portions of the first connecting terminals 11.

The housing 10 includes first outer walls 14*a* which are opposed to each other in a direction in which the pair of the first connecting terminals 11 are juxtaposed, and second outer walls 14*b* which are opposed to each other in a direction intersecting (at right angle in this embodiment) the direction in which the pair of the first connecting terminals 11 are juxtaposed.

Surfaces of both the first and second outer walls 14*a* and 14*b* are formed flat.

When the high voltage fuse 3 has been mounted to the high voltage mounting part 6, the first outer walls 14*a* are opposed to the first surrounding walls 7*a,* and the second outer walls 14*b* are opposed to the second surrounding walls 7*b*.

The first fusible body 12 interconnects the pair of the first connecting terminals 11 within the housing 10. The first fusible body 12 is so adapted to be fused when an amperage of the electric power fed from one of the first connecting terminals 11 has exceeded a threshold value corresponding to the first voltage.

The recesses 13 are provided at comers of the housing 10 where the first outer walls 14*a* are connected to the second outer walls 14*b*. In the illustrated embodiment, the recesses 13 are provided at the four corners of the housing 10. Each of the recesses 13 includes a first wall 13*a* formed in a flat face and displaced from the first outer wall 14*a* in parallel thereto, and a second wall 13*b* formed in a flat face and displaced from the second outer wall 13*b* in parallel thereto.

As described, the recess 13 is formed by indenting both the first outer wall 14*a* and the second outer wall 14*b* which are adjacent to and intersect each other.

When the high voltage fuse 3 has been mounted to the high voltage mounting part 6, the first walls 13*a* are opposed to the first projecting walls 8*a,* and the second walls 13*b* are opposed to the second projecting walls 8*b.* The recesses 13 will not interfere with the projections 8 when the high voltage fuse 3 has been mounted to the high voltage mounting part 6, and will be in alignment with the projections 8 with their walls 13*a,* 13*b* opposed to the walls 8*a,* 8*b* respectively.

According to the above described structure, the fuse block 1 in this embodiment receives the high voltage receiving terminals 9 by inserting them into the fuse box 2 through the terminal insertion opening 6*b.* The high voltage fuse 3 is mounted and detached through the opening 6*a* of the high voltage mounting part 6. When the high voltage fuse 3 has been mounted to the high voltage mounting part 6, the high voltage receiving terminals 9 and the first connecting terminals 11 are connected to each other.

In a state where the high voltage receiving terminals 9 and the first connecting terminals 11 are connected to each other, when the amperage of the current fed from the high voltage power source has exceeded the amperage corresponding to the first voltage, the first fusible body 12 will be fused. Thus, the supply of the electric power to the load connected the other first connecting terminal 11 and the high voltage receiving terminal 9 will be interrupted.

Figure 4:
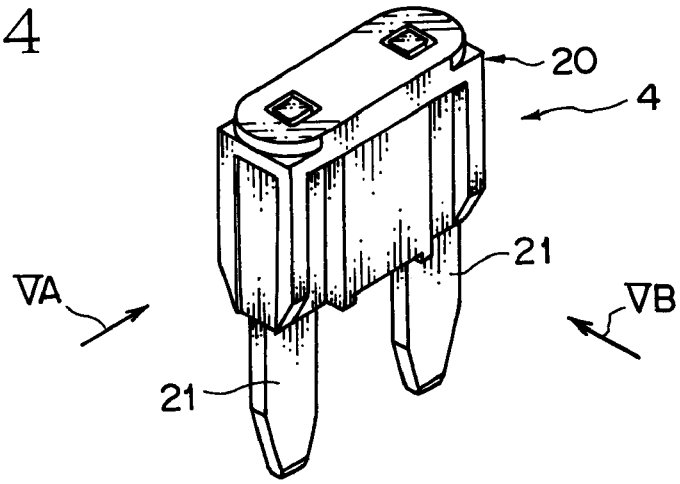
FIG. 4 is a perspective view of a rated voltage fuse.
Figure 5A:
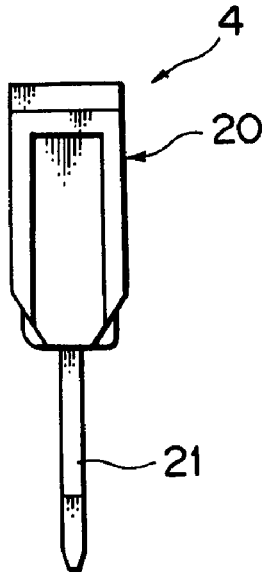
FIG. 5A is a view of the rated voltage fuse as seen from a direction of an arrow VA of FIG. 4.
Figure 5B:
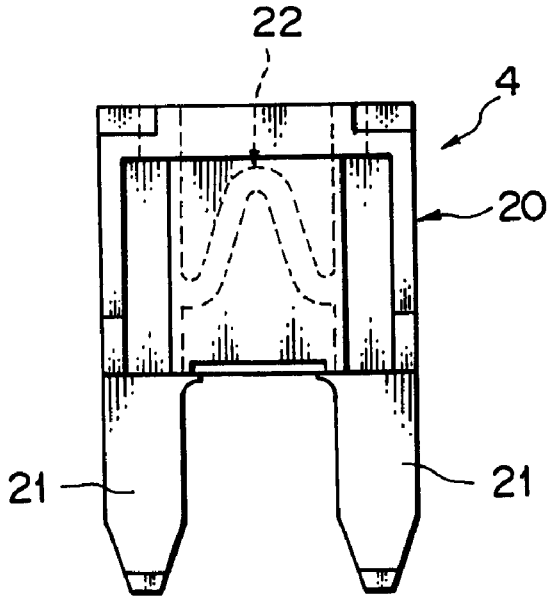
FIG. 5B is a view of the rated voltage fuse as seen from a direction of an arrow VB of FIG. 4.
Figure 6:
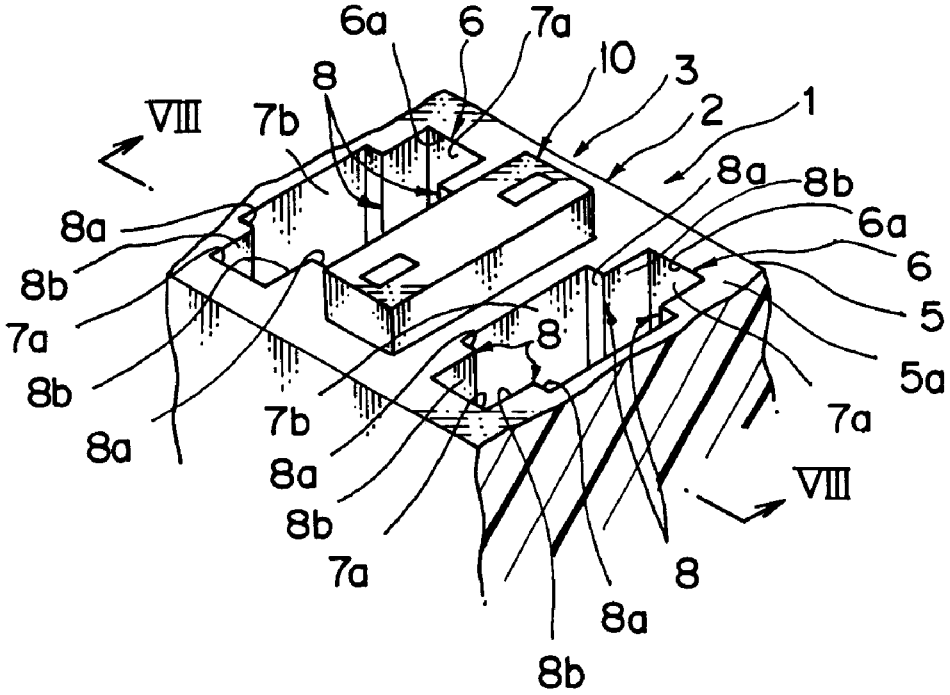
FIG. 6 is a perspective view showing the high voltage fuse mounted on a high voltage mounting part of the fuse box as shown in FIG. 1.
Figure 7:
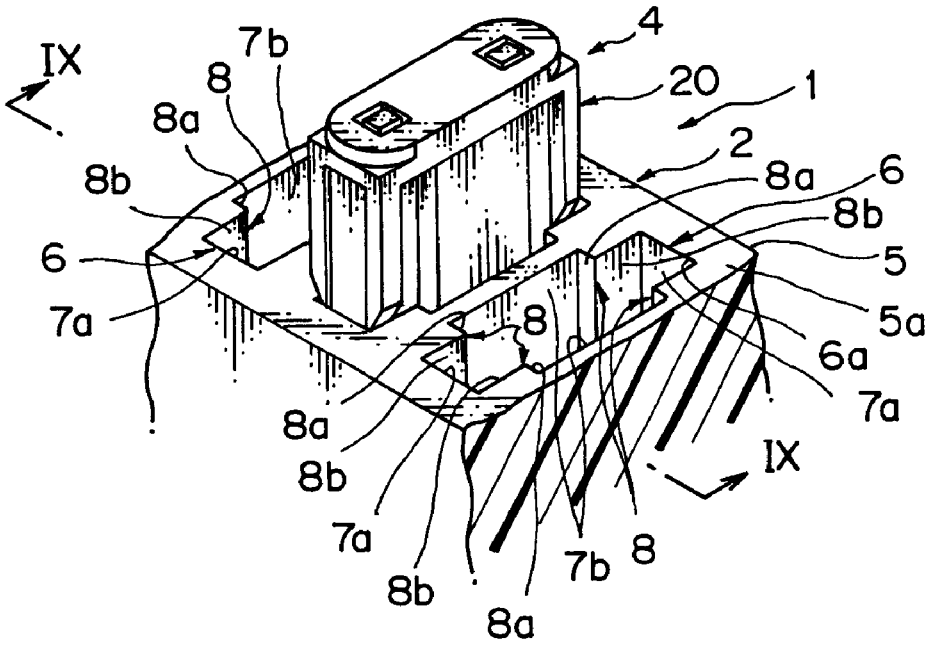
FIG. 7 is a perspective view showing the rated voltage fuse which is being mounted on the high voltage mounting part of the fuse box as shown in FIG. 1.
Figure 8:
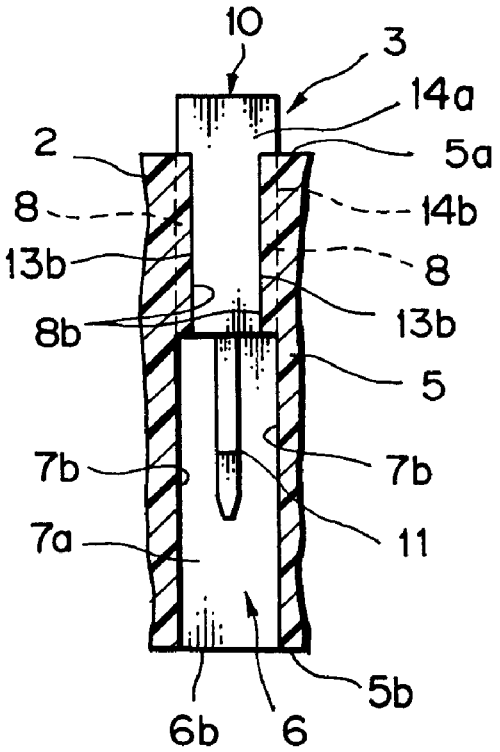
FIG. 8 is a sectional view taken along a line VIII—VIII of FIG. 6.
Figure 9:
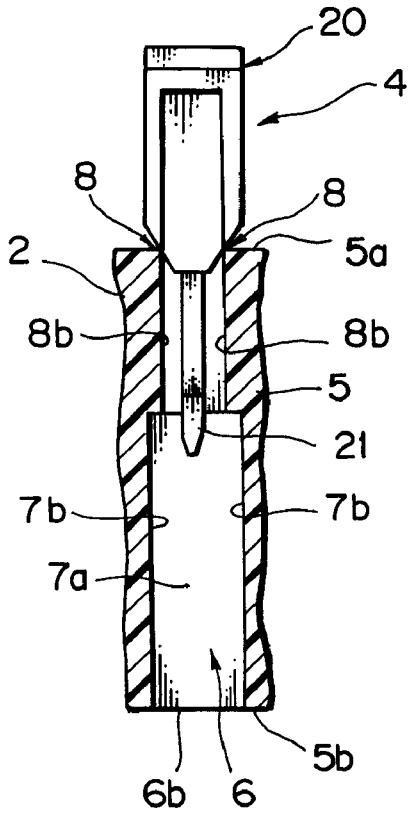
FIG. 9 is a sectional view taken along a line IX—IX of FIG. 7.

According to the present embodiment, the high voltage mounting part 6 is provided with the projections 8 projected from the surrounding walls 7*a,* 7*b.* For this reason, such an error that the rated voltage fuse 4 as the second fuse which is shown in FIGS. 4 and 5 may be mounted to the high voltage mounting part 6 can be avoided. The projections 8 will interfere a housing 20 of the rated voltage fuse 4 to prevent the rated voltage fuse 4 from being mounted to the high voltage mounting part 6.

The rated voltage fuse 4 includes second connecting terminals 21, the second housing 20 and a second fusible body 22 as shown in FIGS. 4 and 5. The second connecting terminals 21 are made of electrically conductive metal and respectively formed in a blade-like shape. The second connecting terminals 21 are arranged in parallel to each other.

The second housing 20 is made of insulating synthetic resin, or the like, and formed in a box-like shape. One of the end portions of the second connecting terminals 21 are each contained in the second housing 20.

The second fusible body 22 is contained in the second housing 20 and interconnects the pair of the second connecting terminals 21. When the amperage of the current fed through one of the second connecting terminals 21 has exceeded the second amperage corresponding to the second voltage of 12V or 24V, for example, which is lower than the aforesaid first voltage, the second fusible body 22 will be fused.

Further, according to this embodiment, the recesses 13 will not interfere but align with the projections 8, the high voltage fuse 3 can be reliably mounted to the high voltage mounting part 6. Accordingly, only the high voltage fuse 3 can be mounted to the high voltage mounting part 6 in this embodiment.

As described, the structure of the fuse block 1 and the fuse box 2 enable the high voltage fuse 3 to be reliably mounted to the high voltage mounting part 6, and prevent the rated voltage fuse 4 from being mounted to the high voltage mounting part 6. Accordingly, the electric power can be reliably supplied to the load connected to the high voltage receiving terminal 9, and at the same time, such a fear that the rated voltage fuse may be melted down resulting in a breakdown of the fuse box 2 or so can be avoided.

Now, a second embodiment of the present invention will be described referring to FIGS. 10 and 11. The same components as those of the first embodiment will be denoted with the same reference numerals, and their explanation will be omitted.

The fuse block 1 in the present embodiment consists of the fuse box 2, the high voltage fuse 3, the rated voltage fuse 4, and so on. The fuse box 2 is formed in a box-like shape, and includes a plurality of the high voltage mounting parts 6, and a plurality of rated voltage mounting parts 26 as second mounting parts.

Each of the rated voltage mounting parts 26 is provided with a terminal insertion hole (not shown) formed on a surface 5*b* of the box body 5. A pair of rated voltage receiving terminals 29 as shown in FIG. 10 are inserted into the rated voltage mounting part 26. These pair of the rated voltage receiving terminals 29 constitute second receiving terminals described in the claims.

One of the rated voltage receiving terminals 29 is electrically connected to a rated voltage power source which supplies the electric power having the second voltage of 12V or 24V, for example, which is lower than the first voltage. The other of the rated voltage receiving terminals 29 is electrically connected to an ordinary load having the second voltage as a rated capacity, such as conventionally known lamps at a vehicle head and tail, horns, various meters installed on an instrument panel, accessories, a room lamp, etc. In this manner, one of the rated voltage receiving terminals 29 is supplied with the electric power having the second voltage which is lower than the first voltage.

Figure 10:
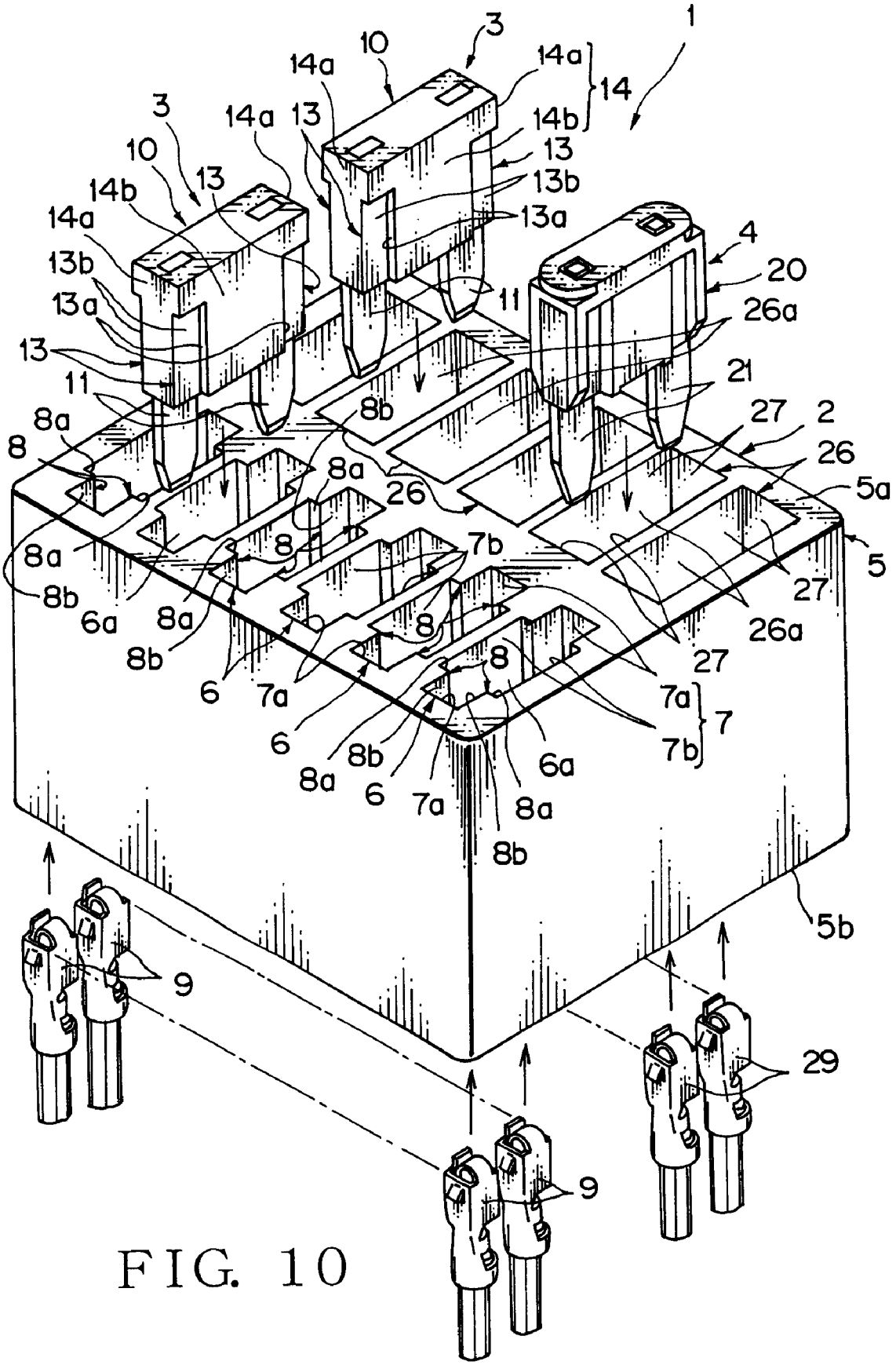
FIG. 10 is a perspective view showing a structure of a fuse block according to a second embodiment of the present invention.

The rated voltage mounting part 26 includes an opening 26*a* which opens in a face 5*a* of the box body 5, and a plurality of surrounding walls 27 continued from peripheral edges of the opening 26*a* as shown in FIG. 10.

Figure 11:
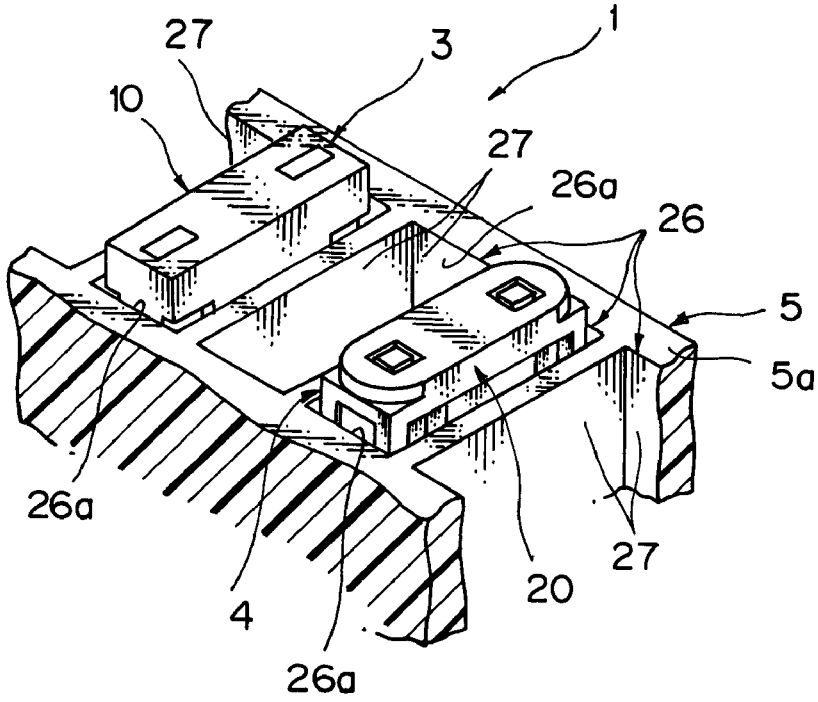
FIG. 11 is a perspective view wherein both the rated voltage fuse and the high voltage fuse have been mounted on the rated voltage mounting part of the fuse box as shown in FIG. 10.

As shown in FIG. 11, both the high voltage fuse 3 and the rated voltage fuse 4 can be mounted in the rated voltage mounting part 26 through the opening 26*a*. When the rated voltage fuse 4 has been mounted in the rated voltage mounting part 26, the second connecting terminals 21 are respectively connected to the rated voltage receiving terminals 29.

In the fuse block 1 of this embodiment, the high voltage mounting part 6 is provided with the projections 8 which blocks the rated voltage fuse 4 from being mounted, and the high voltage fuse 3 is provided with recesses 13 which will not interfere with the projections 8. Therefore, only the high voltage fuse 3 can be inserted into the high voltage mounting part 6.

When assembling the fuse box 1, it should be tried as a first step, to insert the rated voltage fuses 4 into all the mounting parts 6, 26. Then, the rated voltage fuses 4 can be inserted only into the rated voltage mounting parts 26. Thereafter, into the remaining high voltage mounting parts 6, are inserted the high voltage fuses 3. According to such assembling method, the high voltage fuses 3 can be reliably inserted into the high voltage mounting parts 6, while the rated voltage fuses 4 only can be reliably inserted into the rated voltage mounting parts 26.

Accordingly, the high voltage fuses 3 and the rated voltage fuses 4, which are adapted to fuse at different voltages, can be reliably mounted in the high voltage mounting parts 6 and the rated voltage mounting parts 26 respectively.

In the same manner as in the first embodiment, the high voltage fuses 3 can be reliably mounted in the high voltage mounting parts 6, and the rated voltage fuses 4 can be prevented from being mounted in the high voltage mounting parts 6. Therefore, the electric power can be reliably fed to the loads connected to the high voltage receiving terminals 9, and at the same time, such a fear that the rated fuses may be melted down resulting in a breakdown of the fuse box 2 can be avoided.

Further, the high voltage fuses 3 can be mounted in both the high voltage mounting parts 6 and the rated voltage mounting parts 26. Therefore, the electric power can be reliably supplied to the various loads, even though the high voltage fuses 3 only are used in the fuse box 1 having a plurality of the high voltage mounting parts 6 and a plurality of the rated voltage mounting parts 26 which are fed with the electric powers having different voltages.

Accordingly, in the fuse box 1 having a plurality of the high voltage mounting parts 6 and a plurality of the rated voltage mounting parts 26 which are fed with the electric powers having different voltages, types of the components can be restrained.

Furthermore, when assembling the fuse box 1 having a plurality of the high voltage mounting parts 6 and a plurality of the rated voltage mounting parts 26 which are fed with the electric powers having different voltages, there will be no need of identifying types of the fuses.

Although the present invention has been fully described by way of examples with reference to the accompanying drawings, it is to be noted that various changes and modifications can be made within the scope of the present invention.

What is claimed is:

1. In combination, a fuse box and a fuse for use therein, said fuse box comprising:

a body having oppositely spaced, substantially parallel surfaces and at least one first mounting part defined by a through-opening in said body extending between said surfaces, said through-opening having substantially rectangularly disposed side walls extending between said body surfaces, said through-opening being arranged to receive from one end thereof, and to contain, a pair of receiving terminals disposed in mutually parallel relation with respect to each other, one of said receiving terminals being supplied with electric power having a voltage higher than 32V, blocking means disposed in at least one first mounting part including a projection extending from a wall of said through-opening, whereby said through-opening has a sectional profile through said through-opening containing an obstruction defined by said projection, wherein said fuse for use in said fuse box includes a housing having recess means in an exterior surface thereof and defining a transverse sectional profile conforming with the sectional profile of said through-opening to permit reception of a fuse housing into the other end thereof and connecting means extending from a fuse housing for reception by said receiving terminals.

2. The fuse box as claimed in claim 1, wherein said first mounting part is defined by a plurality of surrounding walls continued from peripheral edges of said through-opening, and said blocking means includes projections which are projected from said surrounding walls into said first mounting part.

3. The use box as claimed in claim 2, wherein said surrounding walls of said first mounting part include a pair of first surrounding walls which are opposed to each other in a direction in which said first receiving terminals are juxtaposed, and a pair of second surrounding walls which are continued from said first surrounding walls and opposed to each other in a direction intersecting the direction in which said first receiving terminals are juxtaposed, and said projections project from both said first surrounding walls and said second surrounding walls which are adjacent to each other across said first surrounding walls and second surrounding walls.

4. A fuse comprising:

a pair of connecting terminals arranged in parallel to each other, one of said connecting terminals being used for supplying an electric power having a first voltage higher than 32V; and a housing adapted to receive an end portion of said connecting terminals, wherein said housing includes outer walls forming an outer shell, and at least one recess formed in at least one of said outer walls, said at least one recess extending from an end of said shell part way to the other end thereof.

5. The fuse as claimed in claim 4, wherein said outer walls of the housing include a pair of first outer walls which are opposed to each other in a direction in which said first connecting terminals are juxtaposed, and a pair of second outer walls which are continued from said first outer walls and opposed to each other in a direction intersecting the direction in which said first connecting terminals are juxtaposed, and said at least one recess is provided at an intersection of said first outer walls and said second outer walls which are adjacent to each other.

6. In combination, a fuse block and fuse means for use therein, said fuse block comprising:

a body formed in a box-like shape having oppositely spaced, substantially parallel surfaces;

a first mounting part adapted to receive a pair of first receiving terminals arranged in parallel to each other and having one of said first receiving terminals being supplied with electric power having a first voltage higher than 32V;

a second mounting part adapted to receive a pair of second receiving terminals arranged in parallel to each other and having one of said second receiving terminals being supplied with electric power having a second voltage lower than said first voltage, said first and second mounting parts each being defined by a through-opening having surrounding walls extending between said body surfaces;

said fuse means including a first fuse having a pair of first connecting terminals which are arranged in parallel to each other and adapted to be respectively connected to said first receiving terminals, and a first fusible body which is adapted to fuse when the electric power whose amperage is higher than a value corresponding to said first voltage has been supplied, said first fuse being adapted to be inserted into one end of said through-opening and be detachably mounted to said first mounting part, and a second fuse having a pair of second connecting terminals which are arranged in parallel to each other and adapted to be respectively connected to said second receiving terminals, and a second fusible body which is adapted to fuse when electric power whose amperage is higher than a value corresponding to said second voltage has been supplied, said second fuse being adapted to be detachably mounted to said second mounting part, wherein said first mounting part includes blocking means formed by a projection which is projected from said surrounding walls into said first mounting part and defining a sectional profile through said through-opening, and said first fuse includes said pair of first connecting terminals and a housing having a recess in an exterior surface thereof and defining a transverse sectional profile conforming with the sectional profile of said through-opening to permit reception of a fuse housing into the other end of said through-opening.

7. The fuse block as claimed in claim 6, wherein said surrounding walls of said first mounting part include a pair of first surrounding walls which are opposed to each other in a direction in which said first receiving terminals are juxtaposed, and a pair of second surrounding walls which are continued from said first surrounding walls and opposed to each other in a direction intersecting the direction in which said first receiving terminals are juxtaposed, said outer walls of the housing include a pair of first outer walls which are opposed to each other in a direction in which said first connecting terminals are juxtaposed, and a pair of second outer walls which are continued from said first outer walls and opposed to each other in a direction intersecting the direction in which said first connecting terminals are juxtaposed, said projection is formed by projecting from said first surrounding walls and said second surrounding walls which are adjacent to each other across said first surrounding walls and second surrounding walls, and said recess is formed at an intersection of said first outer walls and said second outer walls which are adjacent to each other across said first outer walls and said second outer walls.

8. The fuse block as claimed in claim 7, wherein said projection and said recess come into alignment when said first fuse has been mounted to said first mounting part.

* * * * *